United States Patent [19]

Grawey

[11] Patent Number: 4,520,868

[45] Date of Patent: Jun. 4, 1985

[54] HEAT EXCHANGER

[75] Inventor: Charles E. Grawey, Peoria, Ill.

[73] Assignee: Caterpillar Tractor Co., Peoria, Ill.

[21] Appl. No.: 443,811

[22] Filed: Nov. 22, 1982

[51] Int. Cl.[3] ..... F28F 9/04

[52] U.S. Cl. ..... 165/158; 165/159

[58] Field of Search ..... 165/158, 159, 161, 162

[56] References Cited

U.S. PATENT DOCUMENTS

| | | | |
|---|---|---|---|
| 2,225,856 | 12/1940 | Buck | 257/220 |
| 2,240,537 | 5/1941 | Young | 257/154 |
| 3,301,321 | 1/1967 | Poore | 165/178 |
| 3,311,164 | 3/1967 | Cox | 165/95 |
| 3,332,479 | 7/1967 | Martin, Jr. | 165/158 |
| 3,447,603 | 6/1969 | Jones | 165/178 |
| 4,328,862 | 5/1982 | Gossalter | 165/158 |

FOREIGN PATENT DOCUMENTS

| | | | |
|---|---|---|---|
| 1064966 | 9/1959 | Fed. Rep. of Germany . | |
| 2339364 | 2/1975 | Fed. Rep. of Germany . | |
| 1089816 | 3/1955 | France | 165/158 |
| 1449311 | 8/1966 | France . | |
| 1578617 | 8/1969 | France . | |
| 1477839 | 6/1977 | United Kingdom . | |
| 1590032 | 5/1981 | United Kingdom . | |

*Primary Examiner*—William R. Cline
*Assistant Examiner*—Peggy A. Neils
*Attorney, Agent, or Firm*—Robert A. McFall

[57] ABSTRACT

A heat exchanger (10) having a plurality of longitudinally-extending tubes (16) disposed within a shell (12) includes an elastomeric end plate (18) and means (22) for compresing the elastomeric end plate (18) and expanding the plate in the longitudinal direction and internal vibration-damping baffle plates (28).

Conventional metal heat exchangers of brazed construction are prone to cracking and failure. More recently, heat exchangers having an end wall assembly comprising an elastic medium disposed between movable pressure plates has been proposed. Among other problems, the movable pressure plates are required to have clearance holes for the free passage of tubes therethrough and are consequently severely limited to the number and density of tubes that may be accommodated in a heat exchanger of such a design.

The present invention avoids the problems of the prior art by providing an end wall assembly for a heat exchanger (10) wherein an elastomeric end plate (18) is mounted under compression in only a direction transverse to the tubes (16) passing through the plate (18). The elastomeric end plate (18) is not restrained in a longitudinal direction with respect to the tubes (16) and as a result of the transversely-applied compression force, the end plate (18) is expanded in the longitudinal direction. The vibration energy absorbing baffle plates (28) have a hardness less than that of the tubes (16).

The heat exchanger (10) of the present invention is particularly useful for severe-duty cycle, vibration-prone vehicular applications.

12 Claims, 2 Drawing Figures

HEAT EXCHANGER

DESCRIPTION

1. Technical Field

This invention relates generally to heat transfer and more particularly to an improved heat exchanger for transferring heat between two fluids.

2. Background Art

Heat exchangers comprising a tube bundle enclosed in a case or housing, generally identified as shell-and-tube type heat exchangers, are well known. Traditionally, shell-and-tube heat exchangers have been constructed of metallic materials. In particular, the tube bundle has conventionally been formed of a plurality of elongated metal tubes that are brazed in a predetermined pattern to a pair of end walls and one or more internal baffle plates. Such brazed assemblies are not only costly, but are also prone to both thermal and vibration-induced mechanical fatigue cracking and subsequent leakage between the fluid chambers at the brazed joints and at the contact points between the tubes and the internal baffle plates. Further, the brazing process tends to anneal the metal tubes, thereby reducing the yield strength of the tubes. In high pressure applications, annealed tubes may collapse, resulting in failure of the heat exchanger.

In an attempt to avoid the above-described inherent problems associated with brazed or soldered heat exchangers, various mechanical sealing arrangements have been proposed. One such example is the tube bundle heat exchanger described in U.S. Pat. No. 4,328,862 issued May 11, 1982 to Rene Gossalter. The Gossalter patent discloses an elastic sealing means for a heat exchanger wherein a pair of pressure plates exert a force in the longitudinal direction of the tube bundle to expand the elastic sealing means in a transverse, or radial, direction thus confining the elastic sealing means in all directions. However, the Gossalter construction still presents a number of problems. First, the requirement for a pair of apertured pressure plates limits the number of tubes that may be enclosed within the shell. As the number of tubes in the tube bundle increases, the number of apertures provided in the pressure plates through which the tubes pass, must also increase. Typically, a 152 mm (6 in.) diameter heat exchanger may contain about 600 tubes having a 4.78 mm (0.188 in. diameter). Forming 600 clearance holes in each of the pressure plates as required in the Gossalter arrangement would not only be extremely costly and time consuming but would also significantly weaken the plate. If the thickness of the pressure plates were increased to add strength, the cost and difficulty of forming the required number of clearance holes would also increase. Further, the pressure plate would be structurally weaker towards the center of the plate and would be unable to apply a uniform, equal compression force across the complete elastic medium interface surface.

An additional deficiency in the prior art as demonstrated in the Gossalter construction is that as the axially applied compressive pressure increases, the sealing surface contact area between the elastic medium and the tubes and shell wall also decreases. Further, if the clamping bolts are overly tightened, the confined elastic medium may easily collapse some of the tubes, especially the relatively small diameter tubes found in high efficiency, high density heat exchangers. This attribute is further worsened by the tendency of maintenance personnel to tighten the clamping bolts if leakage is detected.

In addition to the problems outlined above with respect to brazed and soldered end plate constructions, it has been found that tube fractures may also occur at the surface contact points between the tubes and one or more internal baffle plates. For ease in assembly, it is generally accepted practice to form tube-encircling apertures in the baffle plate to the same or a slightly larger diameter than the external diameter of the tubes. During operation of the heat exchanger, it has been found that the tubes are often subjected to severe vibration both from external sources and from internal fluid pressure pulses. Initially, the lateral displacement or movement of the tubes during various vibrational modes is limited by the close-fitting baffle plates. However, after repeated forced contact either the tubes or the plate, or both, may wear or deform and the clearance between the tube and baffle aperture becomes greater, thereby permitting increased movement of the tube within the baffle. This action not only leads to early mechanical or fatigue failure of the tube but also permits fluid to pass through the enlarged aperture thereby decreasing the flow-directing function of the baffle.

The present invention overcomes the above problems by providing a rugged, economical, and efficient heat exchanger having an end wall assembly that includes a single radially, or transversely, compressed elastomeric end plate. The construction of the present invention avoids the requirement for costly and design-limiting pressure plates. Further, the present invention eliminates the need for adjustable exterior clamping members where improper operation may be an inadvertent cause of damage to the heat exchanger tubes. Still further, as a result of applying the compressive force only in the radial direction, the heat exchanger construction of the present invention provides an arrangement wherein the sealing surface contact area between the elastomeric end plate and each of the tubes and the shell wall increases in response to an increase in the compressive force.

The present invention also overcomes the problem of vibration-induced internal tube damage by providing a vibration-damping baffle plate constructed of a non-metallic material that is considerably softer than the material of the tubes. Further, the baffle plates of the present invention provide an effective non-abrading support between each of the tubes and each of the plates. Still further, the elastomeric end plates and the non-metallic baffle plates cooperate to provide a resilient, vibration energy absorbing support for each of the tubes in the tube bundle.

DISCLOSURE OF THE INVENTION

In accordance with one aspect of the present invention, a heat exchanger includes a shell having an inner wall, a plurality of longitudinally extending tubes disposed within the shell, and an end plate at at least one end of the shell, with the tubes extending through the end plate. The end plate has an elastomeric composition and means are provided for compressing the elastomeric end plate to expand the plate in the longitudinal direction.

In another aspect of the present invention, an end wall assembly for supporting a plurality of longitudinally extending tubes in a shell and for sealing the tubes by forceably contacting an external surface area of each of the tubes with an end plate includes an end plate that has an elastomeric composition and is mounted in a compressed state in the shell and about each of the tubes such that the contact area between the end plate and each of the tubes increases in response to increasing the radial compressive stress on the end plate.

In another aspect of the present invention, an internal baffle plate for a heat exchanger is constructed of a vibration energy absorbing material having a hardness significantly less than the hardness of the tubes.

BEST MODE FOR CARRYING OUT THE INVENTION

Figure 1:
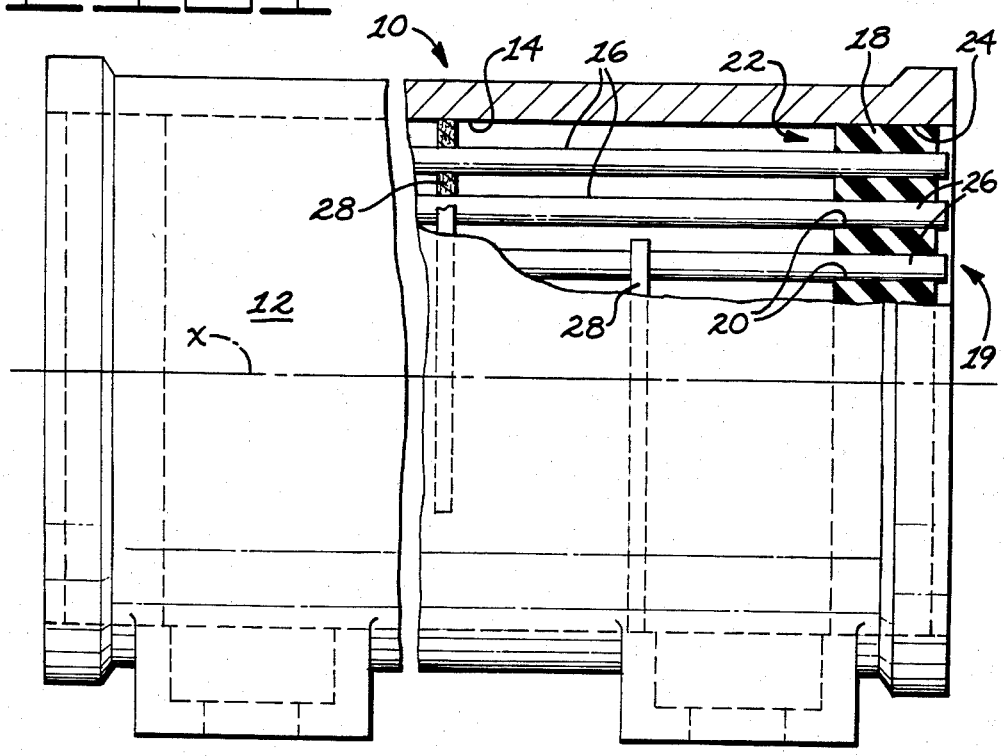
FIG. 1 is a partially sectioned, elevational view of a heat exchanger representing an embodiment of the present invention.
Figure 2:
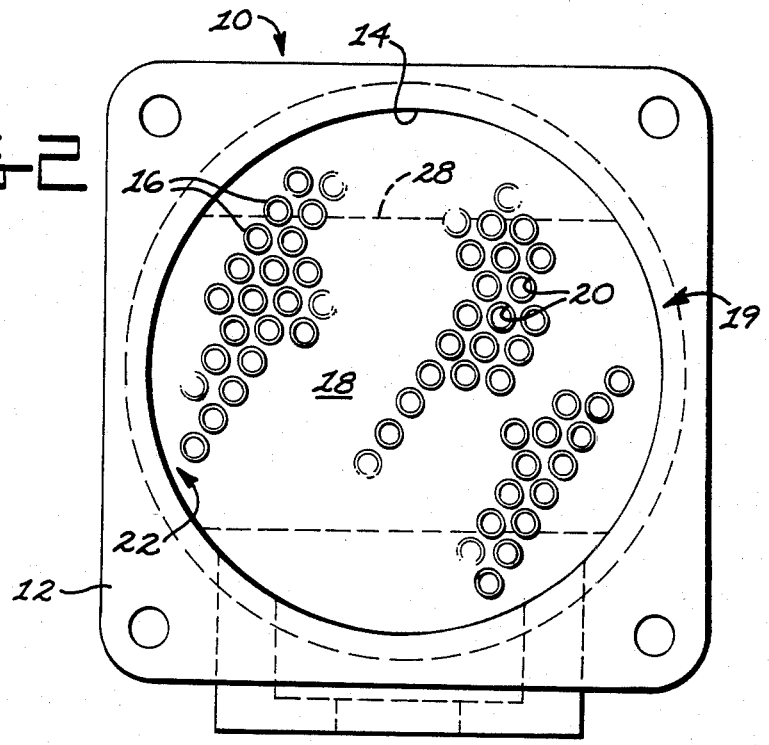
FIG. 2 is an end view of the heat exchanger of FIG. 1.

In the preferred embodiment of the present invention, a heat exchanger 10 includes a conventional shell 12 having an inner wall 14 and a plurality of longitudinally extending tubes 16 disposed within the shell 12. In the example shown in FIG. 1, the heat exchanger 10 is of the single-pass type and has a pair of elastomeric end plates 18 forming part of an end plate assembly 19 at each end of the shell 12 with each of the tubes 16 extending through a respective aperture 20 formed through each of the end plates 18. In heat exchangers of the double-pass type, one end of the heat exchanger may have a solid end wall and the opposite end have an apertured elastomeric end plate assembly 19 constructed according to the present invention. The heat exchanger 10 also includes a plurality of non-metallic internal baffle plates 28 disposed inwardly of the shell 12 at predetermined spaced positions along and normal to the longitudinal axis X of the tubes 16.

Preferably, the elastomeric end plate 18 is constructed of a natural or synthetic resin material having a hardness of from about 45 durometer to about 80 durometer as measured in the Shore A scale. It is necessary that the hardness of the end plate 18 be sufficient to support the tubes 16 in a sealed relationship with respect to the internal chamber defined by the shell 12 and yet not be adversely axially deflected by high pressure pulses that may be transmitted by fluid in the shell chamber. Also, the hardness should not be so high that the transverse compressive stress required for sealing the tube and chamber is not greater than the transverse crush strength of the tubes 16. In addition, the end plate material should have good resistance to the effects of both high and low temperatures and in particular should be resistant to temperature induced deterioration within the thermal operating range of the heat exchanger 10. Further, the end plate material should have good resistance to the deleterious effects of the particular fluids that may be passed through the heat exchanger 10. While by no means being an all-inclusive list, examples of materials having these properties include some compounds of natural rubber, synthetic rubber, and thermoset elastomers such as butyl rubber, chlorosulfonated polyethylene, chloroprene (neoprene), chlorinated polyethylene, nitrile butadiene, epichlorohydrin, polyacrylate rubber, silicone, urethane, fluorosilicone and flourocarbon, and thermoplastic elastomers such as polyurethane, copolyester and polyolefin.

The baffle plates 28 are preferably constructed of a non-metallic, vibration-energy absorbing material having a hardness substantially less than the hardness of the tubes 16, such as an asbestos filled neoprene rubber having a durometer hardness of about 80 on the Shore D scale. Other suitable materials include but are not limited to the compounds listed above with respect to the end plate 18. Combinations of the listed compounds and various metallic, mineral or organic fiber fillers are particularly useful.

A means 22 for compressing the elastomeric end plate 18 includes a continuous surface 24 on the inner wall 14 of the shell 12. The surface 24 circumscribes a transverse area that is somewhat smaller than the unconfined or free-state transverse area of the end plate 18. After the end plate is installed in the shell 12, the inner wall 14 will urge the outer periphery of the end plate 18 radially inwardly and maintain a compressive stress about the circumference of the end plate 18. Further, the means 22 for compressing the elastomeric end plate 18 includes, in combination with the inner wall 14 of the shell 12, an external surface area 26 on each of the tubes 16. The free-state transverse area of each of the apertures 20 is somewhat smaller than the transverse or cross-sectional area of each of tubes 16 so that the external surface area 26 on each of the tubes 16 will urge a portion of the end plate 18 immediately surrounding, or circumscribing, each of the tubes 16 in a direction radially outwardly and maintain a stress on the end plate 18 in a transverse direction with respect to the longitudinal orientation of the tubes 16.

In a preferred embodiment of the present invention, the shell 12 of the heat exchanger 10 is constructed of a ferrous meal composition, has a length of about 762 mm (30.0 in.) and an inner wall 14 diameter of 164.64 mm (6.482 in.). The tubes 16 are copper, have a length of 759 mm (29.88 in.), an outer diameter of 4.78 mm (0.188 in.) and an inner diameter of 4.17 mm (0.164 in.). The tubes 16 are carefully arranged in offset parallel rows inside the shell to provide a large number of tubes and consequently a large heat transfer surface area. The example heat exchanger 10 of the present invention contains 579 of the tubes 16, providing a tube/cross-section area ratio of about 2.7 tubes/$cm^2$. High tube density heat exchangers in this general size group typically range from about 1 to about 3 tubes/$cm^2$.

In the present example, the end plates 18 are constructed of a neoprene rubber composition having a Shore A durometer hardness of 60. The end plate has an unconfined, or free-state, axial thickness, i.e., a dimension measured on the longitudinal direction of the apertures 20 of 23.6 mm (0.93 in.), and a transverse diameter of 172.03 mm (6.773 in.). Each of the apertures 20 have a free-state diameter of 4.22 mm (0.166 in.).

Upon assembly of the end plate 18 in the end of the shell 12 and insertion of the tubes 16 through apertures 20 provided in the end plate 18, as shown in FIG. 1, the outer circumference of the end plate 16 is reduced from the free-state diameter of 172.03 mm to the diameter of the inner wall 14; i.e., 164.64 mm. The end plate 18 is therefore radially compressed by the fixed surface of the inner wall 14 of the shell 12 to a dimension 4.4% less than the unconfined or free-state dimension of the end plate 18, thereby providing and maintaining a radial compressive stress on the periphery of the end plate 18. To achieve the required compressive stress, the end plate 18 should be compressed by the inner wall 14 of the shell 12 to a predetermined dimension at least sufficient to provide an adequate fluid seal between the end plate 18 and the inner wall 14.

Further, the end plate 18 is stressed in the transverse direction by insertion of the tubes 16, or alternatively, by expansion of the tubes 16 after insertion of the tubes 16 through the apertures 20 in the end plate. As listed above, the outer diameter of the tubes 16 is 4.78 mm and the free-state diameter of the apertures 20 is 4.22 mm. The apertures are therefore expanded about 12% in a direction radially outwardly from each of the tubes 16 to establish and maintain a radial stress in the end plate 18 about each of the tubes 16. It is recommended that the apertures 20 be sized so that there is at least an interference fit between a tube 16 and a corresponding aperture 20, and preferably that the diameter of the aperture 20 be expanded by placement of the tube to provide a compressive stress to assure sufficient retention of the tube in the end plate and a fluid seal between the external surface area 26 of the tubes 16 and the end plate 18.

In the example presented above, the end wall is sufficiently stressed in the transverse direction by the inner wall 14 of the shell 12 and the external surfaces 26 of the tubes 16 to axially expand i.e., expand in the longitudinal direction of the tubes 16, the end plate 18 from the free state dimension of 23.6 mm (0.93 in.) to 31.8 mm (1.25 in.). The end plate 16 is therefore axially expanded to a dimension about 34% greater than the unconfined or free-state axial dimension of the end plate. It is easily seen that since the end plate 18 is unrestrained in the axial direction, the amount of elongation, or expansion, in the axial direction is a function of the combined material properties and the transverse compressive stresses provided by the inner wall 14 and tube external surface areas 26. Preferably, the end plate 18 should be sufficiently transversely compressed to expand the plate 18 to a predetermined axial dimension in a range of from about 5% to about 50% greater than the axial dimension of the end plate 18 when measured in an unconfirmed, or free state. Also, it can be easily seen that for a given elastomeric material, the axial elongation of the end plate 18, and consequently the contact area between the end plate 18 and each of the tubes 16 will increase in response to increasing the radial stress on the end plate.

The baffle plates 28 provide support and alignment for the tubes 16 which pass through apertures formed in each of the baffle plates. Further, as is well known in the art, baffle plates form a series of partial dams or flow-directing walls within the shell to provide improved circulation and heat transfer between fluid passing through the shell chamber and fluid passing through the tubes. Conventionally, baffle plates are constructed of a metal and are mechanically positioned within the shell 12 to prevent movement of the baffle plates during operation of the heat exchanger. In the preferred embodiment of the present invention, the baffle plates 28 are constructed of an asbestos-filled neoprene—a non-metallic, vibration-energy absorbing, sheet material, having a Shore D durometer hardness of about 80 and a thickness of 3 mm (0.120 in.). The baffle plates 28 can be adhesively bonded to the external surface of at least some of the copper tubes 16 with nitrile phenolic adhesive to establish an initial position for assembly purposes. The plurality of openings formed in each of the baffle plates 28 for passage of the heat exchanger tubes 16, each have a dimension substantially the same as the outer diameter of the tubes 16. It has been found that with somewhat resilient materials, such as the asbestos-filled neoprene composition of the preferred embodiment, the openings in the baffle plate 28 tend to diminish in cross-sectional area after forming. This characteristic, in combination with the greater thickness of the baffle plates serves to support a sufficient length of the tube to avoid the sharp edges and deleterious wear attributable to the thin metal plates of the prior art constructions. Further, it has been found that the asbestos-filled neoprene composition of the preferred embodiment tends to swell slightly in the presence of oil, thereby increasing the mechanical support and decreasing the amount of leakage about each of the tubes 16 and accordingly improving the heat transfer performance when oil is the fluid medium circulated through the outer chamber of the heat exchanger 10.

INDUSTRIAL APPLICABILITY

Heat exchangers 10 having the end wall and baffle plate assemblies of the present invention have been found to be particularly suitable for use in vehicular applications. The high vibration, cyclic pressure and heat load requirements of vehicle engine, transmission and hydraulic accessory systems have only marginally been satisfied by conventional brazed-assembly metallic heat exchangers.

In one test, a heat exchanger 10 constructed according to the present invention has been installed in the implement hydraulic circuit of a large track-type tractor. The heat exchanger has successfully accummulated over 600 operating hours at the time of the filing of this application for patent. In this particular example, SAE 10 oil at a typical temperature of about 93° C. and at inlet pressure of about 350 kPa passes through the shell chamber and about the external surfaces of the tubes. Coolant having a conventional mixture of water and anti-freeze passes through the tubes 16 at a normal operating temperature of about 82° C. and at an inlet pressure of about 90 kPa. In addition to the above test, heat exchangers of the present invention have been bench tested wherein a pressure of 2100 kPa (305 psi) has been cyclicly applied for an extended time period to the internal shell chamber without failure or leakage of the end wall assembly 19.

The heat exchanger of the present invention is believed suitable for a large number of applications wherein the performance requirements are severe and where heat exchangers of prior art constructions have been inadequate or prone to high failure rates.

Other aspects, objects and advantages of this invention can be obtained from a study of the drawings, the disclosure and the appended claims.

I claim:

1. A heat exchanger, including a rigid, longitudinally-extending, peripheral shell, an end plate of elastomeric material disposed at at least one end of said shell and said elastomeric material having a hardness in the range of about 45 durometer to about 80 durometer as measured on the Shore A scale, a multiplicity of elongate tubes disposed longitudinally within the shell and extending through said end wall, said peripheral shell having an inner wall for urging an outer periphery of the end plate inwardly and maintaining a compressive stress on the periphery of the end plate, and each of said tubes having an external surface area for urging a portion of the end plate circumscribing each of said tubes in a direction radially outwardly from each of the tubes and maintaining a compressive stress on the end plate in a transverse direction with respect to the longitudinal direction of said tubes sufficient, when combined with the compressive stress on the periphery of the end plate, to expand the end plate in the longitudinal direction about one-third ($\frac{1}{3}$) greater than the longitudinal dimension of said end plate when measured in an unconfined state, and a plurality of unitary baffle plates disposed within said shell in a predetermined spaced relationship along and normal to said longitudinally disposed tubes, each baffle plate having a multiplicity of openings for respectively supporting some of said tubes, and formed of a vibration energy absorbing material having a hardness less than a predetermined hardness of said tubes.

2. A heat exchanger, as set forth in claim 1, wherein said baffle plate has a thickness of about 3 mm and a hardness of about 80 durometer as measured on the Shore D scale.

3. A heat exchanger, as set forth in claim 1, wherein said baffle plate is constructed of a material selected from the group including compounds of natural rubber, synthetic rubber, thermoset elastomers, thermoplastic elastomers thermoset plastics and thermoplastic plastics.

4. A heat exchanger, as set forth in claim 3, wherein the material is fiber reinforced.

5. A heat exchanger, as set forth in claim 1, wherein said elongate tubes are constructed of copper and said baffle plate is constructed of a fiber reinforced material having physical characteristics similar to filled neoprene rubber.

6. A heat exchanger including a rigid, longitudinally-extending, peripheral shell having a continuous, smooth inner surface at least at one end thereof; a multiplicity of elongate tubes disposed longitudinally within the shell and extending to said one end; and an end plate of elastomeric material compressably sealed against the tubes and against the smooth inner surface of the shell at said one end, the elastomeric material having a hardness in the range of about 45 durometer to about 80 durometer as measured on the Shore A scale, said end plate being compressed in a transverse direction by both the tubes and the smooth inner surface of the shell but unrestrained in the longitudinal direction, the applied transverse compressive stresses provided by the combination of the shell and the tubes being sufficient to expand the end plate in the unrestrained longitudinal direction about 5% to about 50% greater than the longitudinal dimension of said end plate when measured in an unconfined state.

7. A heat exchanger, as set forth in claim 6, wherein said heat exchanger includes another end plate at an opposite end of said shell constructed of an elastomeric material having a hardness from about 45 durometer to about 80 durometer as measured on the Shore A scale.

8. A heat exchanger, as set forth in claim 6, wherein said tubes have a predetermined hardness, and wherein said heat exchanger includes at least one baffle plate located intermediate the ends of the shell, positioned normal to said longitudinal direction and constructed of a vibration energy absorbing material having a hardness less than the hardness of said tubes.

9. A heat exchanger, as set forth in claim 6, wherein said end plate is constructed of a neoprene rubber composition having a hardness of about 60 durometer as measured on the Shore A scale and is expanded to a predetermined longitudinal dimension about one-third ($\frac{1}{3}$) greater than the radially unconfined axial dimension of said plate.

10. A heat exchanger, as set forth in claim 6, wherein the ratio of the number of tubes to the transverse area of the end plate is in a range from about 1 tube/$cm^2$ to about 3 tubes/$cm^2$.

11. A heat exchanger, as set forth in claim 6, wherein said end plate is constructed of a neoprene rubber composition having a hardness of about 60 durometer as measured on the Shore A scale.

12. A heat exchanger, as set forth in claim 6, wherein said end plate is expanded to a predetermined longitudinal dimension about one-third ($\frac{1}{3}$) greater than the radially unconfined axial dimension of said plate.

* * * * *